United States Patent [19]

Higby et al.

[11] Patent Number: 4,798,548

[45] Date of Patent: Jan. 17, 1989

[54] PROPELLER SHAFT BEARING HOUSING RETENTION SYSTEM

[75] Inventors: Jeffrey P. Higby, Waukegan; Kennedy K. McElroy, Lindenhurst, both of Ill.; Philip A. Zorc, St. Joseph, Mich.

[73] Assignee: Outboard Marine Corporation, Waukegan, Ill.

[21] Appl. No.: 142,006

[22] Filed: Jan. 11, 1988

[51] Int. Cl.[4] ..... B63H 21/28

[52] U.S. Cl. ..... 440/78; 411/518

[58] Field of Search ..... 440/75, 76, 78, 83, 440/900; 411/518, 517, 511

[56] References Cited

U.S. PATENT DOCUMENTS

| | | | |
|---|---|---|---|
| 2,487,802 | 11/1949 | Heimann . | |
| 2,544,631 | 3/1951 | Heimann et al. | 411/518 |
| 2,595,787 | 5/1952 | Heimann | 411/518 |
| 2,660,913 | 12/1953 | Frisby | 411/518 |
| 2,896,287 | 7/1959 | Stultz | 411/516 |
| 3,943,790 | 3/1978 | Meyer | 74/417 |
| 3,968,767 | 7/1976 | Blanchard | 115/5 E |
| 4,256,010 | 3/1981 | Petrie | 411/518 |
| 4,413,865 | 11/1983 | Hackbarth | 308/207 R |
| 4,435,963 | 3/1984 | Shigeru | 63/18 |

FOREIGN PATENT DOCUMENTS

| | | |
|---|---|---|
| 583630 | 11/1959 | Canada . |
| 1112675 | 8/1961 | Fed. Rep. of Germany . |
| 894783 | 1/1945 | France . |
| 92240 | 10/1959 | Netherlands . |

*Primary Examiner*—Sherman D. Basinger
*Assistant Examiner*—Edwin L. Swinehart
*Attorney, Agent, or Firm*—Michael, Best & Friedrich

[57] ABSTRACT

Disclosed herein is a marine propulsion device comprising an internal combustion engine, a lower unit including a rotatably mounted propeller shaft drivingly connected to the internal combustion engine and a propeller mounted on the propeller shaft, the lower unit further including a gearcase housing having an interior groove and a locating shoulder, a propeller shaft bearing housing within the gearcase housing engaging the locating shoulder, a beveled retaining ring received in the interior groove and engaging the propeller shaft bearing housing to bias the propeller shaft bearing housing against the locating shoulder, and a locking mechanism for preventing rotation of the propeller shaft bearing housing relative to the gearcase housing and for preventing disengagement of the beveled retaining ring from the interior groove.

18 Claims, 1 Drawing Sheet

PROPELLER SHAFT BEARING HOUSING RETENTION SYSTEM

BACKGROUND OF THE INVENTION

This invention relates generally to marine propulsion devices, and, more particularly, to an arrangement for retaining a propeller shaft bearing housing within a gearcase housing in such a marine propulsion device.

In marine propulsion devices, such as outboard motors and stern drive units, a rotatable propeller shaft is typically supported by means of a propeller shaft bearing housing. In addition to supporting the propeller shaft against radial or sidewise forces, the propeller shaft bearing housing also functions to support the propeller shaft against large, axially directed reverse thrust forces developed during reverse operation of the propeller. To function effectively, it is necessary that the propeller shaft bearing housing be securely mounted to the gearcase housing of the marine propulsion device and supported against rotation relative to the gearcase housing.

Known methods of securing a propeller shaft bearing housing within a gearcase housing include the use of retaining bolts for securing the two housings to one another, the use of a pair of snap rings set in grooves cut in the gearcase and clamped between a bearing housing and a ring by a set of screws, the use of a large threaded ring threadedly engaging the gearcase housing behind the bearing housing, and the use of metal tabs connected to the bearing housing by means of bolts. Each of these methods can involve complex, time consuming and expensive manufacturing and assembly procedures.

Attention is directed to the following U.S. and foreign patent documents:

| | | |
|---|---|---|
| Shigeru | 4,435,963 | Mar. 13, 1984 |
| Hackbarth | 4,413,865 | Nov. 8, 1983 |
| Petrie | 4,256,010 | Mar. 17, 1981 |
| Blanchard | 3,968,767 | July 13, 1976 |
| Meyer | 3,943,790 | Mar. 16, 1976 |
| Stultz | 2,896,287 | July 28, 1959 |
| Frisby | 2,660,913 | Dec. 1, 1953 |
| Heimann | 2,595,787 | May 6, 1952 |
| Heimann, et al. | 2,544,631 | Mar. 6, 1951 |
| Heimann | 2,487,802 | Nov. 15, 1949 |
| (Canada) | 583,630 | Sept. 22, 1959 |
| (Germany) | 1,112,675 | Aug. 10, 1961 |
| (France) | 894,783 | Jan. 5, 1945 |
| (Netherlands) | 92,240 | Oct. 15, 1959 |

SUMMARY OF THE INVENTION

The invention provides a marine propulsion device comprising an internal combustion engine and a lower unit including a rotatably mounted propeller shaft drivingly connected to the internal combustion engine and a propeller mounted on the propeller shaft, the lower unit further including a gearcase housing having an interior groove and a locating shoulder, a propeller shaft bearing housing within the gearcase housing and engaging the locating shoulder, and a beveled retaining ring received in the interior groove and engaging the propeller shaft bearing housing to bias the propeller shaft bearing housing against the locating shoulder.

In one embodiment, the lower unit further includes locking means engaging the propeller shaft bearing housing and the gearcase housing for preventing relative rotation between the propeller shaft bearing housing and the gearcase housing.

In one embodiment, the locking means comprises a rigid washer, a recess formed partially in the propeller shaft bearing housing and partially in the gearcase housing and dimensioned to receive the washer, and fastener means for securing the washer within the recess.

In one embodiment, the beveled retaining ring includes a pair of opposed spaced ends and the locking means is disposed substantially between the opposed spaced ends whereby substantial movement of the opposed spaced ends toward one another is substantially prevented by the locking means.

In one embodiment, the fastening means engages the propeller shaft bearing housing such that limited linear movement of the propeller shaft bearing housing relative to the gearcase housing is permitted while rotational movement of the propeller shaft bearing housing relative to the gearcase housing is substantially prevented.

The invention also provides a retention system for retaining a propeller shaft bearing housing in a marine propulsion device, the retention system comprising a gearcase housing adapted to receive the propeller shaft bearing housing, locating means within the gearcase housing for limiting linear movement of the propeller shaft bearing housing in a predetermined direction relative to the gearcase housing, an expandable and contractable retaining ring engaging the gearcase housing and the propeller shaft bearing housing to retain the propeller shaft bearing housing within the gearcase housing, and means responsive to expansion of the retaining ring for biasing the propeller shaft bearing housing in the predetermined direction and into engagement with the locating means in response to expansion of the retaining ring.

In one embodiment, the gearcase housing includes an interior groove adapted to receive the retaining ring, and the biasing means includes one or more beveled surfaces on the retaining ring or the interior groove for biasing the retaining ring in the predetermined direction in response to expansion of the retaining ring.

In one embodiment, the retention system further includes locking means adapted to engage the propeller shaft bearing housing and the gearcase housing for preventing relative rotation between the propeller shaft bearing housing and the gearcase housing when the propeller shaft bearing housing is received in the gearcase housing.

The invention also provides a gearcase assembly for a marine propulsion device comprising an elongate propeller shaft bearing housing, a gearcase housing substantially enclosing the propeller shaft bearing housing, the gearcase housing having a cavity and an inner wall including an annular interior groove encircling the propeller shaft bearing housing and having a locating shoulder for limiting linear movement of the propeller shaft bearing housing in a predetermined direction relative to the gearcase housing, an expandable and contractable beveled retaining ring received in the groove having a flat surface engaging the propeller shaft bearing housing and having a beveled surface engaging the gearcase housing so as to bias the retaining ring against the propeller shaft bearing housing and thereby bias the propeller shaft bearing housing in the predetermined direction and against the locating shoulder in response to expansion of the retaining ring within the interior groove, and locking means engaging the propeller shaft bearing housing in the gearcase for preventing rotational movement of the propeller shaft bearing housing within the gearcase housing while permitting limited linear movement of the propeller shaft bearing housing in the predetermined direction relative to the gearcase housing.

Various other principal features of the invention will become apparent to those skilled in the art upon review of the following detailed description, claims, and drawings.

Figure 1:
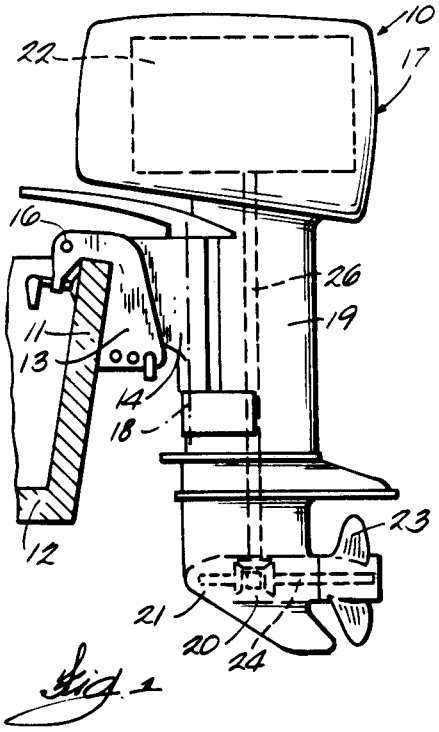
FIG. 1 is a side-elevational view of a marine propulsion device which includes a propeller shaft bearing housing retention system and which embodies various of the features of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for purposes of description and should not be regarding as limiting.

DESCRIPTION OF THE PREFERRED EMBODIMENT

A marine propulsion device 10 embodying the invention as illustrated in the drawings. As best shown in FIG. 1, the marine propulsion device 10 comprises a mounting assembly fixedly attached to the transom 11 of a boat 12. While various suitable mounting assemblies can be employed, in the preferred embodiment the mounting assembly includes a transom bracket 13 fixedly attached to the transom 11, and a swivel bracket 14 mounted on the transom bracket 13 for pivotal movement of the swivel bracket 14 relative to the transom bracket 13 around a generally horizontal tilt axis 16.

The marine propulsion device 10 also comprises a propulsion unit 17 mounted on the swivel bracket 14 for pivotal movement of the propulsion unit 17 relative to the swivel bracket 14 around a generally vertical steering axis 18. The propulsion unit 17 includes a lower unit 19 having a gearcase housing 21 including an interior cavity and further includes an internal combustion engine 22 mounted on the lower unit 19. The lower unit 19 further includes a propeller 23 mounted on a propeller shaft 24 rotatably mounted within the gearcase housing 21 and drivingly connected to the internal combustion engine 22 by means of a driveshaft 26.

Figure 2:
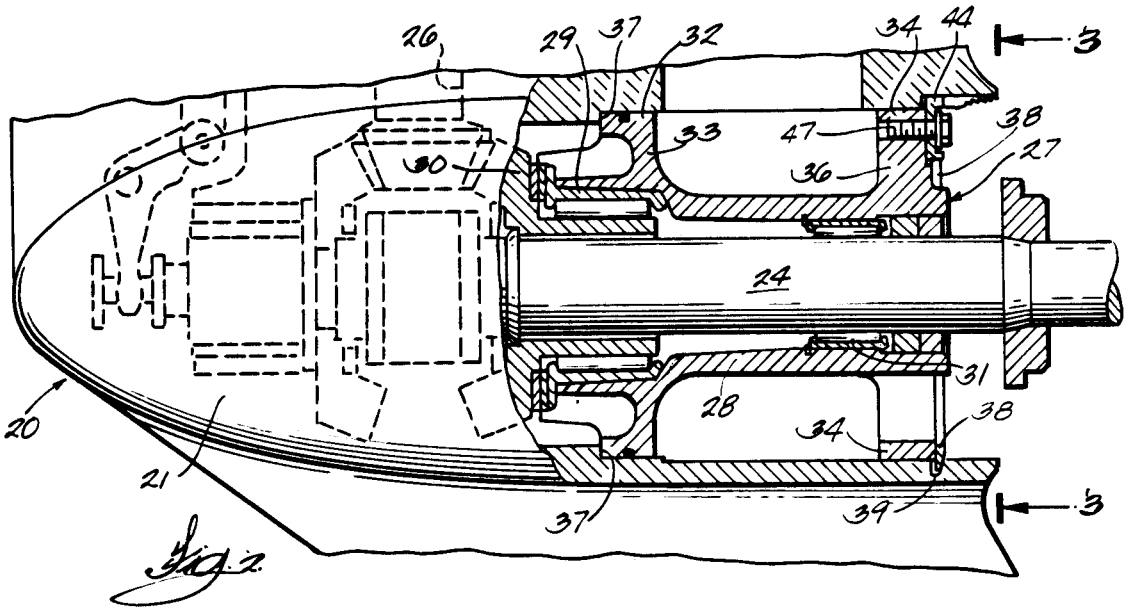
FIG. 2 is a side elevational view, partially in section, of a gearcase assembly as utilized in the marine propulsion device shown in FIG. 1.

The gearcase assembly 20 is shown in detail in FIG. 2 and includes an elongate propeller shaft bearing housing 27 for rotatably supporting the propeller shaft 24 within the interior cavity of the gearcase housing 21. The propeller shaft bearing housing 27 includes a hollow, substantially cylindrical shaft tube 28 having therein mounted one or more bearing assemblies 31 for rotatably supporting the propeller shaft 24, and an additional bearing assembly 29 for supporting a gear 30 positioned around, and selectively engageable with, the propeller shaft 24.

The propeller shaft bearing housing 27 further includes a substantially circular forward mounting ring 32 encircling the forward bearing assembly 29 and connected to the shaft tube 28 by means of an integrally formed solid web 33. A rear support ring 34 encircles the rear bearing assembly 31 and is connected to the shaft tube 28 by means of a solid web or a plurality of spokes 36 as may be needed to permit exhaust flow. Both the forward support ring 32 and the rear support ring 34 are dimensioned to be received within the gear case housing 21 and thereby support therein the propeller bearing housing 27.

To retain the propeller shaft bearing housing 27 within the marine propulsion device 10, the gearcase assembly includes a retention system comprising locating means within the gearcase housing 21 for limiting linear movement of the propeller shaft bearing housing 27 in a predetermined direction relative to the gearcase housing 21. Although various suitable locating means can be used, in the illustrated construction, the locating means includes an annular locating shoulder 37, formed in the gearcase housing 21, dimensioned to engage the forward support ring 32 and thereby limit forward movement (to the left in FIG. 2) of the propeller shaft bearing housing 27 relative to the gearcase housing 21.

To retain the propeller shaft bearing housing 27 within the gearcase housing 21, the retention system further comprises an interior groove 39 formed in the inner wall of the cavity within the gearcase housing 21 and an expandable and contractable retaining ring 38 received in the interior groove 39 and engaging the propeller shaft bearing housing 27 adjacent the periphery of the rear support ring 34 to retain the propeller shaft bearing housing 27 within the gearcase housing 21. Preferably, the retaining ring 38 is formed of a durable material, such as stainless steel.

To further maintain the position of the propeller shaft bearing housing 27 within the gearcase housing 21, the circular retaining ring 38 includes a substantially flat surface 41, for engaging the rear support ring 34, and a beveled surface 42 opposite the flat surface 41 for engaging the gearcase housing 21 along the interior groove 39. The orientation of the beveled surface 42 is such that the circular retaining ring 38 is of least or minimum thickness at its outermost circumferential periphery. Preferably, the interior groove 39 includes an angled or beveled sidewall 43 shaped and oriented so as to be substantially parallel to the beveled surface 42 of the retaining ring 38.

Figure 4:
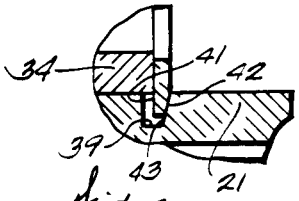
FIG. 4 is an enlarged fragmentary view showing, in detail, a beveled retaining ring received in an interior groove formed in a gearcase housing.

As will be appreciated by further reference to FIGS. 2 and 4, expansion of the retaining ring 38 into the interior groove 39 results in the beveled surface 42 acting against the mating bevel of the sidewall 43 to forwardly force the retaining ring 38 and thereby bias the propeller shaft bearing housing into engagement with the shoulder 37 of the gearcase housing 21. In order to assure that the retaining ring 38 does, in fact, bias the propeller shaft bearing housing 27 against the shoulder 37, it is desirable that the interior groove 39 be dimensioned and shaped so that clearance is maintained between all sides of the retaining ring 38 and the gearcase housing 21 except where the beveled surface 42 of the retaining ring engages the beveled sidewall 43 of the interior groove 39 when the propeller shaft bearing housing 27 is biased fully against the shoulder 37.

During operation of the marine propulsion device, it is desirable to restrain the propeller shaft bearing housing 27 against rotation relative to the gearcase housing 21. Accordingly, the retention system includes locking means adapted to engage the propeller shaft bearing housing 27 and the gearcase housing 21 for preventing relative rotation between the propeller shaft bearing housing and the gearcase housing when the propeller shaft bearing housing is received in the gearcase housing. While various suitable locking means are available, in the illustrated embodiment, the locking means comprises a circular washer 44 adapted to be received in a generally cylindrical recess 46 formed partially in the propeller shaft bearing housing 27 and partially within the gearcase housing 21.

Figure 5:
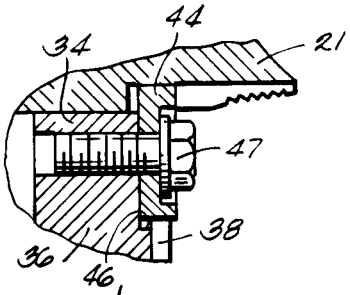
FIG. 5 is an enlarged fragmentary view of a locking assembly as utilized in the gearcase assembly illustrated in FIG. 2.
Figure 3:
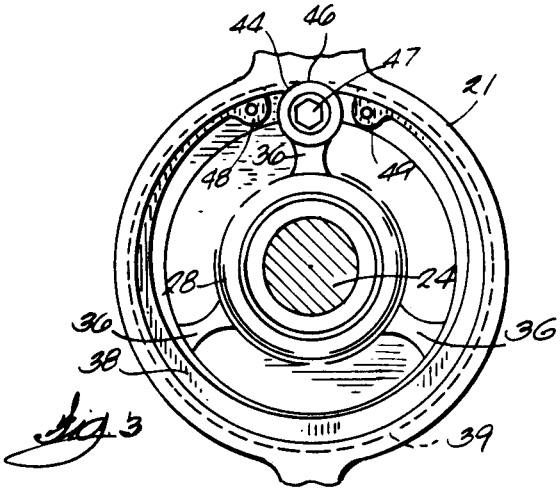
FIG. 3 is a cross-sectional view of the gearcase assembly illustrated in FIG. 2, taken along line 3—3 thereof.

The locking means further comprises a fastener, such as a screw 47, threadedly engaging the rear support ring 34 of the propeller shaft bearing housing 27 for securing the washer 44 within the recess 46. When so secured, within the recess 46, the washer 44, as best illustrated in FIGS. 3 and 5, extends somewhat beyond the outer peripheral edge of the rear support ring 34 and thereby prevents relative rotation between the propeller shaft bearing housing 27 and the gearcase housing 21. Preferably, the washer 44 is formed of a durable material, such as stainless steel, and is of substantial thickness so as to adequately resist any tendency of the propeller shaft bearing housing to rotate within the gearcase housing 21.

To permit the retaining ring to bias the propeller shaft bearing housing 27 against the locating shoulder 37, the locking means for preventing rotation of the propeller shaft bearing housing 27 relative to the gearcase housing 21 is preferably arranged so as to permit at least limited, linear, forward and rearward movement of the propeller shaft bearing housing relative to the gearcase housing 21. To this end, a tight fit between the washer 44 and the cylindrical recess 46 is avoided so that some forward and rearward movement of the washer 44 within the portion of the recess 46 formed in the gearcase housing 21 can occur substantially without opposition.

As illustrated in FIG. 3, the retaining ring 38 includes a pair of opposed, spaced ends 48 and 49 which can be drawn together to reduce the effective diameter of the retaining ring and thereby permit the retaining ring to be installed in, or removed from, the interior groove 39. Once the retaining ring 38 has been installed in the interior groove 39, it is desirable to prevent unintentional movement of the retaining ring ends 48 and 49 toward one another, which movement could permit the retaining ring to escape from the interior groove 39. To prevent such an occurrence, the washer 44, together with the cylindrical recess 46 and the screw 47, are preferably disposed between the opposed ends 48 and 49 of the retaining ring 38 and are installed subsequent to installation of the retaining ring. Additionally, the thickness of the washer 44, together with the screw 47, is sufficient to assure that the washer and screw project beyond the interior groove 39 in the rearward direction. When thus installed, the washer 44 and screw 47 together form an obstacle to substantial movement of the retaining ring ends 48 and 49 toward one another, with the result that the chance for inadvertent escape of the retaining ring 38 from the interior groove 39 is substantially eliminated. If it is desired to remove the propeller shaft bearing housing from the gearcase housing 21, the screw 47 and washer 44 can first be removed, after which the retaining ring ends 48 and 49 can be drawn toward one another so as to remove the retaining ring 38 in the ordinary manner.

Because the propeller shaft bearing housing retention system herein shown and described utilizes relatively few, and economically manufactured, parts, manufacturing costs are reduced when compared to prior retention systems. Furthermore, because each of the elements of the retention system can be easily and quickly installed into the gearcase assembly, assembly procedures are simplified and greater manufacturing economy can, thereby, be realized.

Although the propeller shaft bearing housing retention system has been shown and described in the context of an outboard motor, it will be appreciated that the propeller shaft bearing housing retention system can also be used in other types of marine propulsion devices such as stern drive units.

Various other features and advantages of the invention are set forth in the following claims.

We claim:

1. A marine propulsion device comprising an internal combustion engine and a lower unit including a rotatably mounted propeller shaft drivingly connected to said internal combustion engine and a propeller mounted on said propeller shaft, said lower unit further including a gearcase housing having an interior groove and a locating shoulder, a propeller shaft bearing housing within said gearcase housing engaging said locating shoulder, and a beveled retaining ring received in said interior groove and engaging said propeller shaft bearing housing to bias said propeller shaft bearing housing against said locating shoulder.

2. A marine propulsion device according to claim 1 wherein said lower unit further includes locking means engaging said propeller shaft bearing housing and said gearcase housing for preventing relative rotation between said propeller shaft bearing housing and said gearcase housing.

3. A marine propulsion device in accordance with claim 2 wherein said locking means comprises a rigid washer, a recess formed partially in said propeller shaft bearing housing and partially in said gearcase housing and dimensioned to receive said washer, and fastener means for securing said washer within said recess.

4. A marine propulsion device in accordance with claim 3 wherein said fastening means engages said propeller shaft bearing housing such that limited linear movement of said propeller shaft bearing housing relative to said gearcase housing is permitted while rotational movement of said propeller shaft bearing housing relative to said gearcase housing is substantially prevented.

5. A marine propulsion device in accordance with claim 2 wherein said beveled retaining ring includes a pair of opposed spaced ends and wherein said locking means is disposed substantially between said opposed spaced ends whereby substantial movement of said opposed spaced ends toward one another is substantially prevented by said locking means.

6. A marine propulsion device according to claim 5 wherein said locking means comprises a washer, a recess formed partially in said propeller shaft bearing housing and partially in said gearcase housing and dimensioned to receive said washer, and fastener means for securing said washer within said recess, and wherein said recess is positioned such that said washer is disposed substantially between said pair of opposed spaced ends when said washer is secured within said recess such that substantial movement of said opposed spaced ends toward one another is substantially prevented by said washer.

7. A retention system for retaining a propeller shaft bearing housing in a marine propulsion device, said retention system comprising a gearcase housing adapted to receive the propeller shaft bearing housing, locating means within said gearcase housing for limiting linear movement of the propeller shaft bearing housing in a predetermined direction relative to said gearcase housing, and an expandable and contractable retaining ring engaging said gearcase housing and the propeller shaft bearing housing to retain the propeller shaft bearing housing within said gearcase housing, and means responsive to expansion of said retaining ring for biasing the propeller shaft bearing housing in said predetermined direction and into engagement with said locating means in response to expansion of said retaining ring.

8. A retention system in accordance with claim 7 wherein said gearcase housing includes a cavity having a wall and an interior groove within said wall and adapted to receive said retaining ring and wherein said biasing means includes at least one beveled surface on at least one of said retaining ring and said interior groove for biasing said retaining ring in said predetermined direction in response to expansion of said retaining ring.

9. A retention system in accordance with claim 8 wherein said retaining ring includes a flat surface adapted to engage said propeller shaft bearing housing and a beveled surface opposite said flat surface, and wherein said interior groove includes an additional beveled surface adapted to engage said beveled surface of said retaining ring.

10. A retention system in accordance with claim 9 wherein said interior groove is positioned to extend circumferentially around the propeller shaft bearing housing, and wherein the minimum width of said interior groove is greater than the maximum thickness of said retaining ring whereby said retaining ring is displaceable in said predetermined direction in response to expansion of said retaining ring within said interior groove.

11. A retention system in accordance with claim 7 wherein said retention system further includes locking means adapted to engage the propeller shaft bearing housing and said gearcase housing for preventing relative rotation between the propeller shaft bearing housing and said gearcase housing when the propeller shaft bearing housing is received in said gearcase housing.

12. A retention system in accordance with claim 11 wherein said locking means comprises a washer, a recess formed partially in the propeller shaft bearing housing and partially in said gearcase housing and dimensioned to receive said washer, and fastener means for securing said washer within said recess.

13. A retention system in accordance with claim 12 wherein said retaining ring includes a pair of opposed spaced ends and wherein said locking means is positionable between said opposed spaced ends such that contraction of said retaining ring is substantially prevented by said locking means when said locking means is disposed between said opposed spaced ends.

14. A gearcase assembly for a marine propulsion device comprising an elongate propeller shaft bearing housing, a gearcase housing substantially enclosing said propeller shaft bearing housing, said gearcase housing having a cavity and an inner wall including an annular interior groove encircling said propeller shaft bearing housing and having a locating shoulder for limiting linear movement of said propeller shaft bearing housing in a predetermined direction relative to said gearcase housing, an expandable and contractable beveled retaining ring received in said groove, having a flat surface engaging said propeller shaft bearing housing, and having a beveled surface engaging said gearcase housing so as to bias said retaining ring against said propeller shaft bearing housing and thereby bias said propeller shaft bearing housing in said predetermined direction and against said locating shoulder in response to expansion of said retaining ring within said interior groove, and locking means engaging said propeller shaft bearing housing in said gearcase for preventing rotational movement of said propeller shaft bearing housing within said gearcase housing while permitting limited linear movement of said propeller shaft bearing housing in said predetermined direction relative to said gearcase housing.

15. A gearcase assembly in accordance with claim 14 wherein said locking means includes a rigid washer, a recess formed partially in said propeller shaft bearing housing and partially in said gearcase housing and dimensioned to receive said rigid washer, and fastener means for securing said rigid washer within said recess.

16. A gearcase assembly in accordance with claim 15 wherein said fastener means engages said propeller shaft bearing housing such that limited linear movement of said propeller shaft bearing housing in said predetermined direction relative to said gearcase housing is permitted while rotational movement of said propeller shaft bearing housing relative to said gearcase housing is substantially prevented.

17. A gearcase assembly in accordance with claim 14 wherein said interior groove includes a beveled surface for engaging said beveled surface of said retaining ring and wherein the width of said interior groove is greater than the thickness of said retaining ring whereby said retaining ring is displaceable in said predetermined direction in response to expansion of said retaining ring within said interior groove.

18. A gearcase assembly in accordance with claim 17 wherein said retaining ring includes a pair of opposed spaced ends and wherein said locking means is disposed between said opposed spaced ends such that contraction of said retaining ring is substantially prevented.

* * * * *